US011235570B2

(12) United States Patent
Kachi et al.

(10) Patent No.: US 11,235,570 B2
(45) Date of Patent: Feb. 1, 2022

(54) LIQUID DISCHARGE APPARATUS

(71) Applicants: Yasuhiko Kachi, Kanagawa (JP); Shohei Saito, Kanagawa (JP)

(72) Inventors: Yasuhiko Kachi, Kanagawa (JP); Shohei Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 16/928,184

(22) Filed: Jul. 14, 2020

(65) Prior Publication Data

US 2021/0031508 A1 Feb. 4, 2021

(30) Foreign Application Priority Data

Jul. 31, 2019 (JP) ..... JP2019-140645
May 19, 2020 (JP) ..... JP2020-087377

(51) Int. Cl.
*B41J 2/045* (2006.01)
*B41J 2/175* (2006.01)
*B41J 2/14* (2006.01)

(52) U.S. Cl.
CPC ..... *B41J 2/0454* (2013.01); *B41J 2/04563* (2013.01); *B41J 2/14201* (2013.01); *B41J 2/175* (2013.01); *B41J 2002/14306* (2013.01); *B41J 2002/14419* (2013.01)

(58) Field of Classification Search
CPC ..... B41J 2/04563; B41J 2/195; B41J 2/0454; B41J 2/18; B41J 29/377; B41J 2/14201; B41J 2/175; B41J 2002/14419; B41J 2002/14306
See application file for complete search history.

(56) References Cited

U.S. PATENT DOCUMENTS 7,758,136 B2 * 7/2010 Kachi ..... B41J 2/175 347/6
8,882,213 B2 * 11/2014 Ghozeil ..... B41J 2/04531 347/6
2009/0021542 A1 * 1/2009 Kanfoush ..... B41J 2/185 347/6
2016/0257113 A1 9/2016 Takeuchi et al.
2017/0173946 A1 6/2017 Yamanaka et al.

FOREIGN PATENT DOCUMENTS

JP 2014-037073 2/2014

* cited by examiner

*Primary Examiner* — An H Do
(74) *Attorney, Agent, or Firm* — Duft & Bornsen, PC

(57) ABSTRACT

A liquid discharge apparatus includes a plurality of head units each of which includes a plurality of heads configured to discharge a liquid, and a plurality of temperature-controlled liquid supply manifolds each of which is configured to distribute the temperature-controlled liquid to the plurality of heads of one of the plurality of head units. The liquid discharge apparatus further includes a conveyor configured to convey a sheet onto which the liquid is applied by the plurality of head units, and the conveyor defines a sheet conveyance passage opposite the plurality of head units. At least one of the plurality of temperature-controlled liquid supply manifolds is disposed between two of the plurality of head units and in a vicinity of the sheet conveyance passage.

8 Claims, 13 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-140645, filed on Jul. 31, 2019, and 2020-087377, filed on May 19, 2020, in the Japan Patent Office, the entire disclosure of each of which is hereby incorporated by reference herein.

BACKGROUND

Technical Field

The present disclosure relates to a liquid discharge apparatus.

Related Art

In a head that discharges a liquid (a liquid discharge head), the temperature of the liquid to be discharged rises inherent to heat generated in a liquid discharge operation. Since the temperature rise causes fluctuations in liquid discharge properties, the head is cooled, for example, with a temperature-controlled liquid whose temperature is controlled. However, when the head is cooled to or below the dew point of the environment, condensation occurs on a nozzle face of the head on which nozzles are formed, and a liquid discharge state fluctuates.

SUMMARY

An embodiment of this disclosure provides a liquid discharge apparatus that includes a plurality of head units each of which includes a plurality of heads configured to discharge a liquid, and a plurality of temperature-controlled liquid supply manifolds each of which is configured to distribute the temperature-controlled liquid to the plurality of heads of one of the plurality of head units. The liquid discharge apparatus further includes a conveyor configured to convey a sheet onto which the liquid is applied by the plurality of head units, and the conveyor defines a sheet conveyance passage opposite the plurality of head units. At least one of the plurality of temperature-controlled liquid supply manifolds is disposed between two of the plurality of head units and in a vicinity of the sheet conveyance passage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
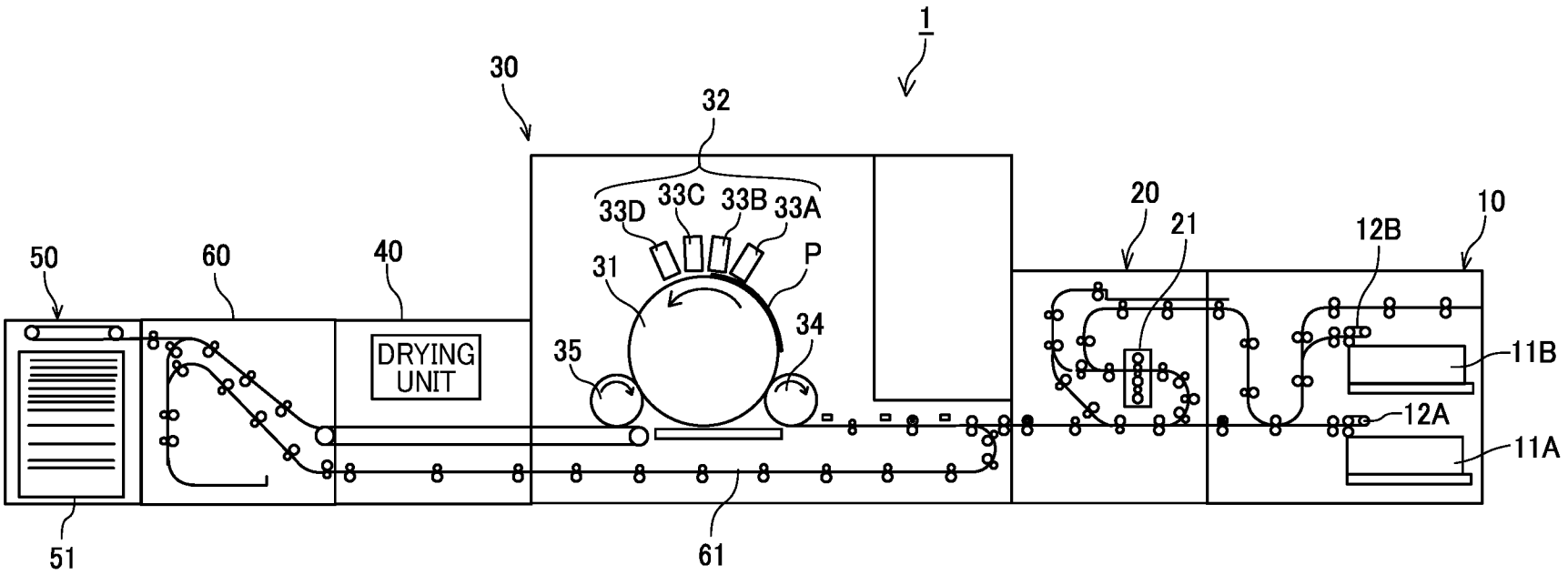
FIG. 1 is a schematic cross-sectional view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

A description is given of a printer as a liquid discharge apparatus according to a first embodiment of the present disclosure, with reference to FIG. 1. FIG. 1 is a schematic cross-sectional front view of the printer according to the first embodiment of the present disclosure.

A printer 1 includes a loading unit 10 to load a sheet P into the printer 1, a pretreatment unit 20, a printing unit 30, a drying unit 40, an unloading unit 50, and a reversing unit 60. In the printer 1, the pretreatment unit 20 applies, as required, a pretreatment liquid onto the sheet P fed (supplied) from the loading unit 10, the printing unit 30 applies a liquid (e.g., ink) to the sheet P, thereby performing printing, and the drying unit 40 dries the liquid adhering to the sheet P, after which the sheet P is ejected to the unloading unit 50.

The loading unit 10 includes loading trays 11 (a lower loading tray 11A and an upper loading tray 11B) to store a plurality of sheets P, feeders 12 (12A and 12B) to separate and feed the sheets P one by one from the loading trays 11, and feeds the sheet P to the pretreatment unit 20.

The pretreatment unit 20 includes an application device 21 that coats an image formation surface of the sheet P with a treatment liquid having an effect of aggregating a colorant of ink to prevent bleed-through.

The printing unit 30 includes a drum 31 (a rotator) to carry and convey the sheet P on an outer peripheral surface thereof and a liquid discharge device 32 to discharge the liquid toward the sheet P carried on the drum 31.

The printing unit 30 includes transfer cylinders 34 and 35. The transfer cylinder 34 receives the sheet P from the pretreatment unit 20 and forwards the sheet P to the drum 31. The transfer cylinder 35 receives and forwards the sheet P conveyed by the drum 31 to the drying unit 40.

The transfer cylinder 34 includes a sheet griper to grip the leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31.

Similarly, the drum 31 includes a sheet gripper on the surface thereof, and the leading end of the sheet P is gripped by the sheet gripper. The drum 31 has a plurality of suction holes dispersedly on the surface thereof, and a suction device generates a suction airflow orienting inward from a predetermined suction hold of the drum 31.

On the drum 31, the sheet gripper grips the leading end of the sheet P forwarded from the transfer cylinder 34, and the sheet P is attracted to and carried on the drum 31 by the suction airflows by the suction device. As the drum 31 rotates, the sheet P is conveyed.

The liquid discharge device 32 includes discharge units 33 (33A to 33D) to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used.

The discharge operation of the discharge unit 33 of the liquid discharge device 32 is controlled by a drive signal corresponding to print data. When the sheet P carried on the drum 31 passes through a region facing the liquid discharge device 32, the respective color liquids are discharged from the discharge units 33, and an image corresponding to the print data is formed.

The drying unit 40 dries the liquid applied onto the sheet P in the printing unit 30. As a result, a liquid component such as moisture in the liquid evaporates, and the colorant contained in the liquid is fixed on the sheet P. Additionally, curling of the sheet P is inhibited.

The reversing unit 60 reverses, in switchback manner, the sheet P that has passed through the drying unit 40 in double-sided printing. The reverted sheet P is fed back to the upstream side of the transfer cylinder 34 through a conveyance passage 61 of the printing unit 30.

The unloading unit 50 includes an unloading tray 51 on which a plurality of sheets P is stacked. The plurality of sheets P conveyed through the reversing unit 60 is sequentially stacked and held on the unloading tray 51.

Figure 2:
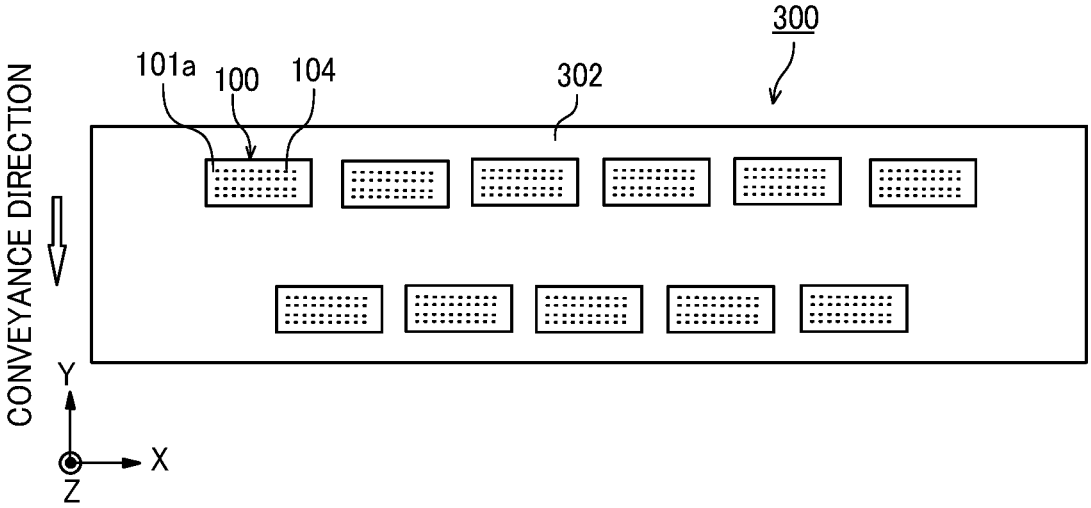
FIG. 2 is a plan view of a head unit as a discharge unit of the liquid discharge apparatus as viewed from a nozzle face side.

Next, an example of a head unit serving as the discharge unit is described with reference to FIG. 2. FIG. 2 is a plan view of the head unit as viewed from a surface of a nozzle plate (i.e., a nozzle face).

A head unit 300 includes a plurality of heads 100 to discharge a liquid. The heads 100 are in a staggered arrangement on a head mount 302.

Each head 100 has a plurality of nozzle rows in each of which a plurality of nozzles 104 to discharge liquid is lined (four rows in this example, but the number of rows is not limited thereto).

Figure 3:
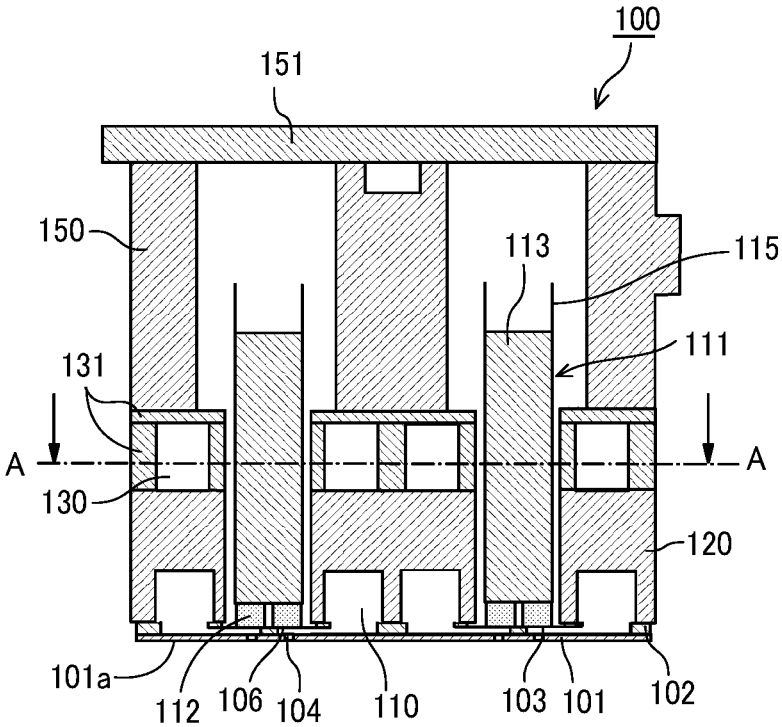
FIG. 3 is a cross-sectional view of an example of a head along a short-side direction (perpendicular to a nozzle row direction in which nozzles rows extend)
Figure 4:
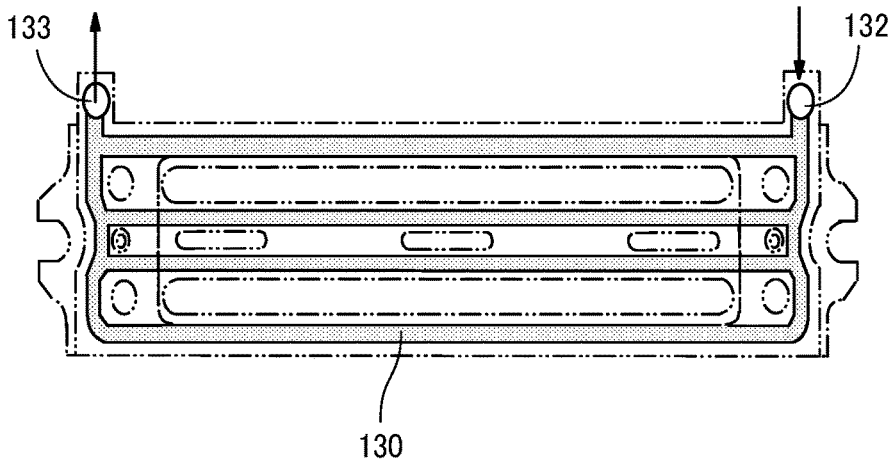
FIG. 4 is a plan view of a channel of a temperature-controlled liquid in the head, taken along line A-A in FIG. 3.

Next, an example of the head 100 is described with reference to FIGS. 3 and 4. FIG. 3 is a cross-sectional view of the head 100 along a short-side direction of the head 100 (perpendicular to the nozzle row direction in which a nozzle row extends). FIG. 4 is a plan view of a temperature-controlled liquid channel 130 of the head 100, taken along line A-A in FIG. 3.

The head 100 includes a nozzle plate 101 in which the nozzles 104 are formed, a channel substrate 102 that defines channels such as pressure chambers 106 communicating with the nozzles 104, and diaphragms 103 forming walls of the pressure chambers 106, which are sequentially stacked. The head 100 further includes a piezoelectric actuator 111, as a pressure generator, and a frame 120 also serving as a common channel member.

The piezoelectric actuator 111 includes a plurality of columnar piezoelectric elements 112 on a base 113. The piezoelectric element 112 is joined to the diaphragm 103. A wiring member 115 of a flexible wiring board is connected to the piezoelectric elements 112.

The frame 120, which also serves as the common channel member, forms a common supply channel 110 to supply the liquid (ink) to be discharged, to the pressure chamber 106.

To the frame 120, a temperature-controlled liquid channel member 131 is joined. The temperature-controlled liquid channel member 131 defines the temperature-controlled liquid channel 130 through which a temperature-controlled liquid flows in the head 100. The temperature-controlled liquid channel member 131 includes a temperature-controlled liquid supply port 132 to supply the temperature-controlled liquid to the temperature-controlled liquid channel 130, and a temperature-controlled liquid collection port 133 from which the temperature-controlled liquid is discharged outside for collection.

Accordingly, in the head 100, the common supply channel 110, which is a flow channel for ink, and the temperature-controlled liquid channel 130 are thermally coupled. The frame 120, serving as the casing of the head 100, defines the wall of the temperature-controlled liquid channel 130, and is thermally coupled to the temperature-controlled liquid channel 130.

On the temperature-controlled liquid channel member 131, a case 150 and a lid 151 are stacked in this order.

Figure 5:
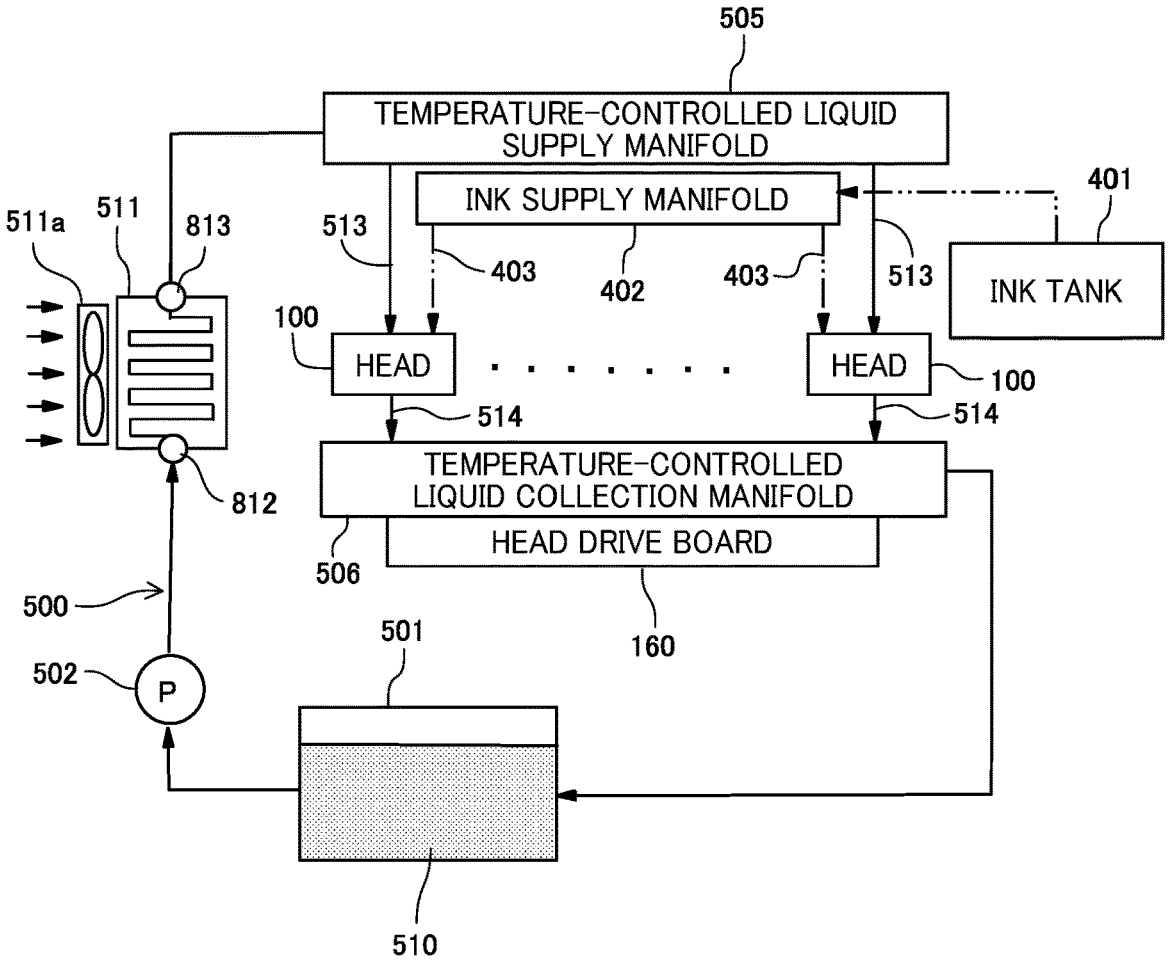
FIG. 5 is a block diagram illustrating a liquid supply system and a circulation system of the temperature-controlled liquid, according to the first embodiment.

Next, a description is given below of a liquid (ink) supply system and a temperature-controlled liquid circulation system according to the first embodiment, with reference to the block diagram in FIG. 5.

The ink supply system includes an ink tank 401 (a liquid tank) that stores ink (liquid) to be supplied to the head 100, and an ink supply manifold 402. The ink supply manifold 402 (a liquid supply manifold) distributes and supplies the ink (the liquid) supplied from the ink tank 401 to the plurality of heads 100. The ink supply manifold 402 and the heads 100 are coupled by an ink supply passage 403 such as a tube.

The temperature-controlled liquid circulation system includes a temperature-controlled liquid tank 501 to store a temperature-controlled liquid 510, a liquid feed pump 502 (a liquid feeder) to feed the temperature-controlled liquid 510, a radiator 511 to cool the temperature-controlled liquid 510, a temperature-controlled liquid supply manifold 505 to distribute and supply the temperature-controlled liquid 510 to the heads 100, and a temperature-controlled liquid collection manifold 506 to collect the temperature-controlled liquid 510 from the heads 100.

The temperature-controlled liquid supply manifold 505 is coupled to the temperature-controlled liquid supply port 132 of each head 100 by a supply passage 513 such as a tube. The temperature-controlled liquid collection manifold 506 is coupled to the temperature-controlled liquid collection port 133 of each head 100 by a collection passage 514 such as a tube.

As the liquid feed pump 502 is driven, the temperature-controlled liquid 510 stored in the temperature-controlled liquid tank 501 circulates through a circulation passage 500 that passes through the liquid feed pump 502, the radiator 511 as a cooler, the temperature-controlled liquid supply manifold 505, each head 100, and the temperature-controlled liquid collection manifold 506. Then, the temperature-controlled liquid 510 returns to the temperature-controlled liquid tank 501.

On a head drive board 160 including a drive circuit for the head 100, a drive waveform generation unit that generates a drive waveforms to be applied to the piezoelectric actuators 111 of the plurality of heads 100 and a power amplification unit that amplifies the drive waveforms are mounted. The head drive board 160 is thermally coupled to the temperature-controlled liquid collection manifold 506.

In the system configured as described above, the liquid feed pump 502 pumps up the temperature-controlled liquid 510 from the temperature-controlled liquid tank 501. Then, the temperature-controlled liquid 510 passes through the radiator 511, and is distributed from the temperature-controlled liquid supply manifold 505 to the heads 100.

As the temperature-controlled liquid 510 passes through the temperature-controlled liquid channel 130 of each head 100, the temperature-controlled liquid 510 cools the frame 120 of the head 100. After passing through the head 100, while flowing in the temperature-controlled liquid collection manifold 506, the temperature-controlled liquid 510 cools the power amplification unit of the head drive board 160 (a drive circuit), and returns to the temperature-controlled liquid tank 501.

Meanwhile, the ink is supplied from the ink tank 401 to the ink supply manifold 402 and distributed to each head 100.

Preferably, the supply flow rate of the temperature-controlled liquid 510 is set to five times or greater of the maximum liquid supply amount to the plurality of heads 100 of the head unit 300. Such a setting can provide a margin of heat absorption relative to the heat generation amount of the heads 100, and a sufficient cooling effect can be obtained.

Figure 6:
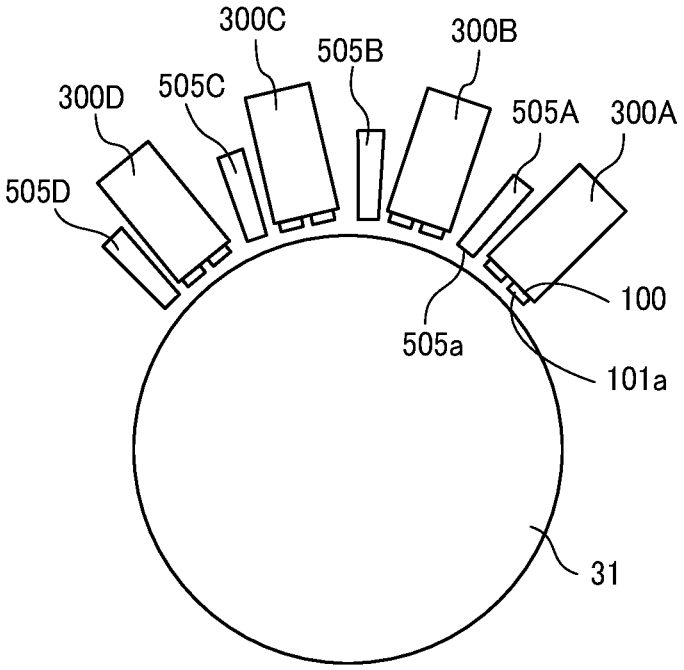
FIG. 6 is a front view of a configuration around a drum of the printer and illustrates an arrangement of the head unit and a temperature-controlled liquid supply manifold according to the first embodiment.

Next, an arrangement of the head unit and the temperature-controlled liquid supply manifold is described with reference to FIG. 6. FIG. 6 is a front view of a configuration around the drum 31 and illustrates an arrangement of the head unit 300 and the temperature-controlled liquid supply manifold 505.

Around the drum 31, the head units 300 (300A to 300D) as the discharge units 33 (33A to 33D) are arranged.

In the present embodiment, corresponding to the head units 300A to 300D, temperature-controlled liquid supply manifolds 505A to 505D are provided to distribute the temperature-controlled liquid 510 to the heads 100 of the corresponding head unit 300. Each of the temperature-controlled liquid supply manifolds 505A to 505D is disposed downstream from the corresponding one of the head units 300A to 300D in the direction of conveyance in the conveyance passage of the sheet P (the peripheral surface of the drum 31).

Therefore, in the present embodiment, each of the temperature-controlled liquid supply manifolds 505A to 505C is disposed between the two head units 300 (the discharge units 33), and the temperature-controlled liquid supply manifold 505D is downstream from the head unit 300D (the discharge unit 33D).

Each of the temperature-controlled liquid supply manifolds 505A to 505D is disposed such that a bottom face 505*a* is in the vicinity of the sheet conveyance passage (the peripheral surface of the drum 31). In the present embodiment, the bottom face 505*a* of the temperature-controlled liquid supply manifold 505 is at a substantially the same height from the peripheral surface of the drum 31 as a nozzle face 101*a* of the head 100, but the positional relation is not limited thereto. The bottom face 505*a* can be at any position as long as condensation on the temperature-controlled liquid supply manifold 505 occurs earlier than the occurrence of condensation on the nozzle face 101*a* of the head 100.

Figure 7:
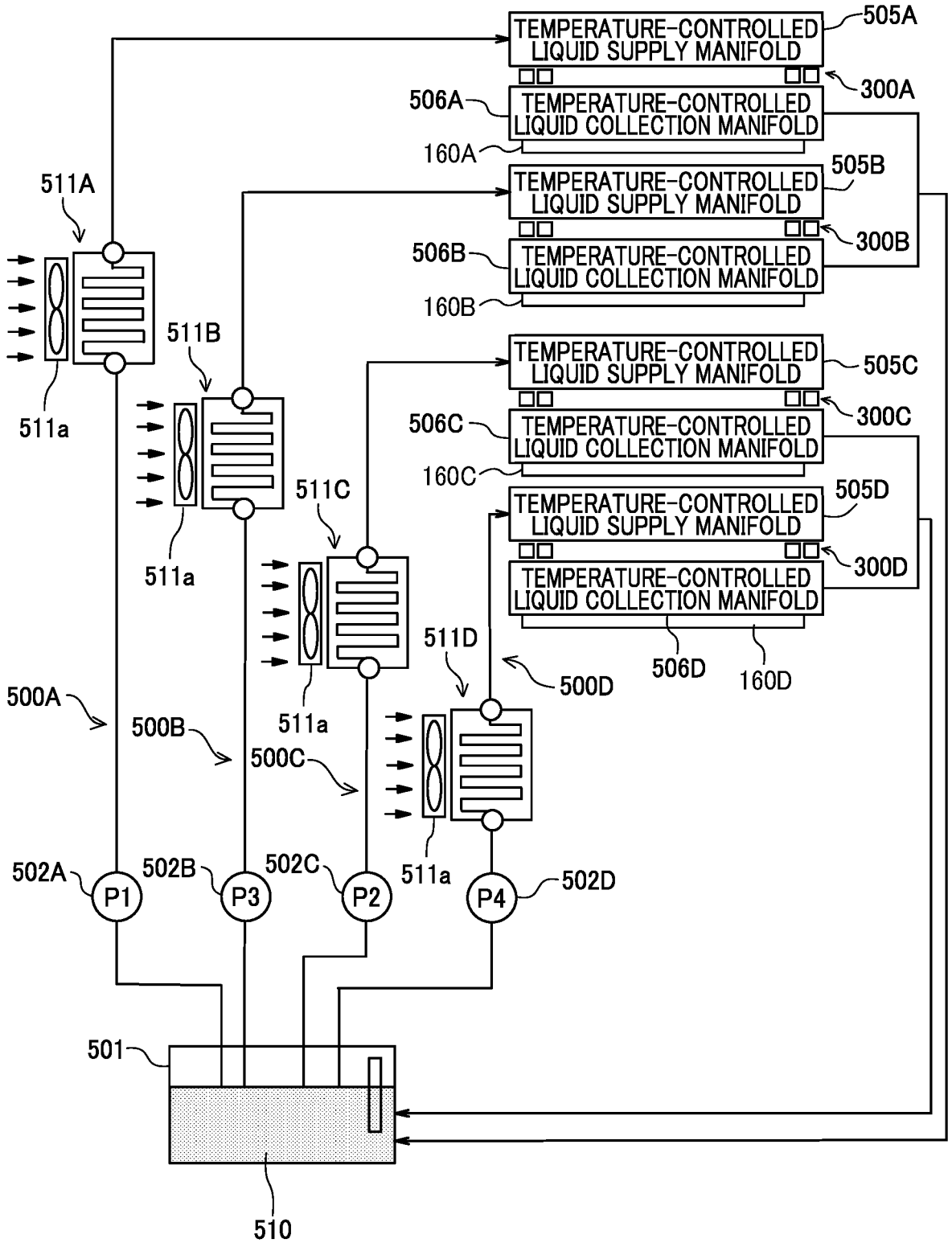
FIG. 7 is a diagram illustrating four temperature-controlled liquid circulation systems for the head units according to the first embodiment.

Next, a description is given of four temperature-controlled liquid circulation systems for the head units in the present embodiment, with reference to FIG. 7. FIG. 7 is a diagram illustrating the four temperature-controlled liquid circulation systems.

The printer 1 includes the plurality of temperature-controlled liquid supply manifolds 505 (505A to 505D) and the plurality of temperature-controlled liquid collection manifolds 506 (506A to 506D) corresponding to the plurality of head units 300 (300A to 300D) each of which includes the plurality of heads 100.

The printer 1 includes the temperature-controlled liquid tank 501 as a common tank. The temperature-controlled liquid 510 is supplied to the temperature-controlled liquid supply manifolds 505 (505A to 505D), respectively, through circulation passages 500 (500A to 500D) branched from the common temperature-controlled liquid tank 501, via the liquid feed pumps 502 (502A to 502D) and radiators 511 (511A to 511D).

By contrast, after passing through the head units 300A to 300D and is collected by the temperature-controlled liquid collection manifolds 506 (506A to 506D), the flows of the temperature-controlled liquid 510 from the temperature-controlled liquid collection manifolds 506A and 506B are merged, and those from the temperature-controlled liquid collection manifolds 506C and 506D are merged. The temperature-controlled liquid 510 is then returned through two separate passages to the temperature-controlled liquid tank 501.

Thus, the circulation passage 500A starts from the temperature-controlled liquid tank 501, passes through the liquid feed pump 502A, the radiator 511A, the temperature-controlled liquid supply manifold 505A, the head unit 300A, and the temperature-controlled liquid collection manifold 506A, and then returns to the temperature-controlled liquid tank 501.

Similarly, the circulation passage 500B starts from the temperature-controlled liquid tank 501, passes through the liquid feed pump 502B, the radiator 511B, the temperature-controlled liquid supply manifold 505B, the head units 300B, and the temperature-controlled liquid collection manifold 506B, and then returns to the temperature-controlled liquid tank 501.

The circulation passage 500C starts from the temperature-controlled liquid tank 501, passes through the liquid feed pump 502C, the radiator 511C, the temperature-controlled liquid supply manifold 505C, the head unit 300C, and the temperature-controlled liquid collection manifold 506C, and then returns to the temperature-controlled liquid tank 501.

The circulation passage 500D starts from the temperature-controlled liquid tank 501, passes through the liquid feed pump 502D, the radiator 511D, the temperature-controlled liquid supply manifold 505D, the head unit 300D, and the temperature-controlled liquid collection manifold 506D, and then returns to the temperature-controlled liquid tank 501.

The head drive boards 160 (160A to 160D) are thermally coupled to the temperature-controlled liquid collection manifolds 506 (506A to 506D), respectively, and cooled by the temperature-controlled liquid 510.

As described above, in the present embodiment, the respective radiators 511 for the head units 300 are connected in parallel.

With this structure, the cooling of the temperature-controlled liquid 510 by the radiator 511 can be controlled based on a control temperature (a predetermined temperature or threshold temperature) set in accordance with the viscosity of the liquid discharged by each head unit 300.

Figure 8:
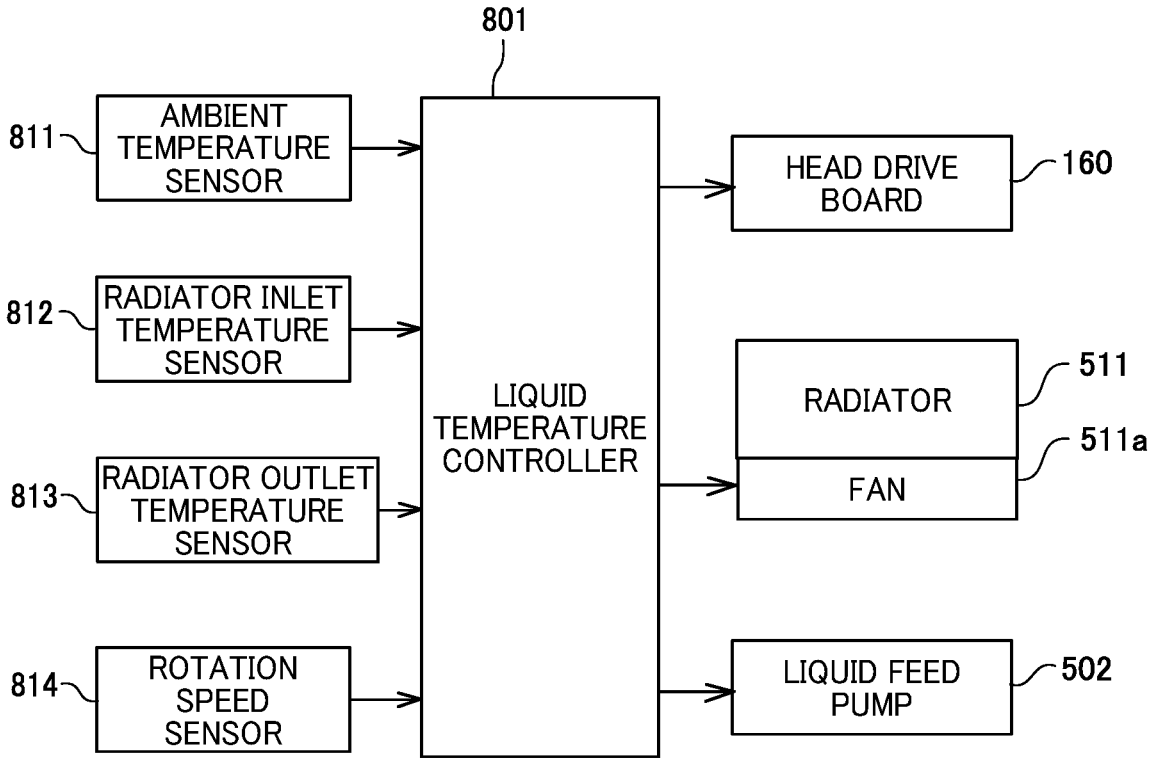
FIG. 8 is a block diagram illustrating a configuration of control of temperature of the temperature-controlled liquid according to the first embodiment.

Next, a description is given of the temperature control of the temperature-controlled liquid, with reference to the block diagram in FIG. 8.

A temperature-controlled liquid temperature controller 801 receives a result of detection of an ambient temperature T5 of the radiator 511 by an ambient temperature sensor 811. Note that the radiator 511 is disposed outside the apparatus not to be affected by a temperature rise inside the apparatus, and the ambient temperature T5 of the radiator 511 is the same as the ambient temperature of the printer 1.

The temperature-controlled liquid temperature controller 801 receives detection results from a radiator inlet temperature sensor 812 (a liquid temperature sensor) to detect a temperature (hereinafter referred to as "inflow temperature") T1 of the temperature-controlled liquid 510 at the inlet of the radiator 511 and a radiator outlet temperature sensor 813 (a liquid temperature sensor) to detect a temperature (hereinafter referred to as "outflow temperature") T3 of the temperature-controlled liquid 510 at the outlet of the radiator 511.

The temperature-controlled liquid temperature controller 801 further receives a detection result from a rotation speed sensor 814 that detects the rotation speed of a fan 511*a* of the radiator 511.

Then, the temperature-controlled liquid temperature controller 801 controls the rotation of the fan 511*a* of the radiator 511 based on such detection results input thereto.

Based on the temperature detection results input thereto, the temperature-controlled liquid temperature controller 801 applies, to the head drive board 160, a drive waveform (a heating waveform) to cause the head drive board 160 to generate heat, thereby heating of the temperature-controlled liquid 510. The head drive board 160 is a temperature adjuster or a heat generator that heats the temperature-adjustment liquid to adjust the temperature thereof, under control of the temperature-controlled liquid temperature controller 801. The head drive board 160 is mounted with a power amplification function (circuitry) for generating a drive waveform for the piezoelectric element 112 and amplifying the waveform and a function (circuitry) for controlling the head 100.

The heat generation amount can be controlled by controlling the head drive board 160 and the drive frequency of a drive waveform for heating, applied to the piezoelectric elements 112. For example, when the ambient temperature is 10° C., the head drive board 160 is heated with a heat generation amount of 8 KW (a frequency of 40 KHz), to sharply raise the temperature in the circulation passage 500. As the temperature in the circulation passage 500 reaches the target of ink temperature control, that is, the ordinary temperature, the drive frequency is reduced to reduce the heat generation amount in order to avoid an overshoot.

Further, the temperature-controlled liquid temperature controller 801 drives the liquid feed pump 502 to circulate the temperature-controlled liquid 510.

In the present embodiment, the temperature-controlled liquid temperature controller 801 adjusts the temperature of the temperature-controlled liquid 510 to the threshold temperature in response to a detection result that the ambient temperature of the head unit 300 is lower than the threshold temperature, and adjusts the temperature of the temperature-controlled liquid 510 to the ambient temperature in response to a detection result that the ambient temperature is higher than the threshold temperature.

That is, since the temperature of the sheet P in a low temperature environment follows the ambient temperature, the temperature of the sheet P after printing on one side is also low. Therefore, the temperature of the head 100 is set to, for example, an ordinary temperature (the threshold temperature, e.g., 25° C.) to provide a temperature difference with the head 100. Then, condensation is unlikely to occur in such an environment. At this time, since the ink temperature follows the temperature of the head 100, a good discharge condition can be obtained.

Figure 9:
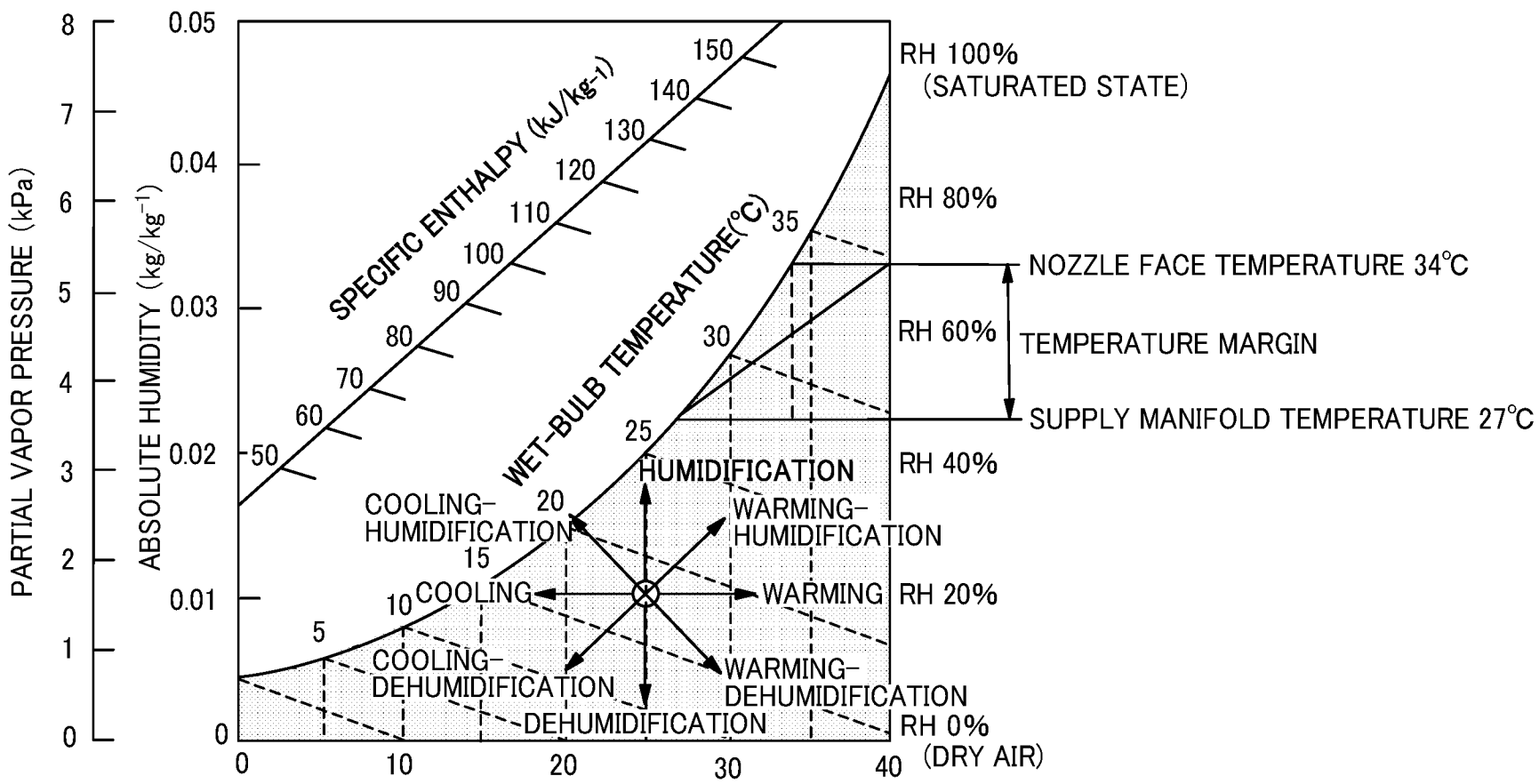
FIG. 9 is a saturated vapor diagram illustrating an action of inhibiting condensation on the head in the first embodiment.

Next, a description is given of an action of inhibiting condensation on the head according to the present embodiment, with reference also to FIG. 9. FIG. 9 is a saturated vapor diagram illustrating the action of inhibiting condensation on the head according to the first embodiment.

In the present embodiment, the temperature-controlled liquid 510 is cooled with the radiator 511 installed outside the apparatus, and the temperature of the temperature-controlled liquid 510 is controlled within a range of an outside temperature (ambient temperature) plus 2 degrees.

Therefore, the temperature of the temperature-controlled liquid supply manifold 505 is controlled within the range of the ambient temperature plus 2 degrees. In the head 100, the temperature-controlled liquid channel 130 is disposed in the vicinity of the common supply channel 110, and the ink temperature is adjusted to the temperature of the temperature-controlled liquid 510. The piezoelectric actuator 111 that applies the discharge pressure is near the pressure chamber 106. Accordingly, the temperature in the pressure chamber 106 and the ink temperature during the printing operation increase by, for example, approximately 7 degrees.

In an example where the ambient temperature is 25° C., the temperature of the temperature-controlled liquid supply manifold 505 is 27° C., the ambient temperature of the nozzle face 101*a* of the head 100 is 34° C., and then the temperature-controlled liquid supply manifold 505 is constantly controlled to be cooler than the nozzle face 101*a* of the head 100.

As described above, since the temperature of the temperature-controlled liquid supply manifold 505 is lower than the dew point of the nozzle face 101*a* by 7° C., condensation occurs on the surface of the temperature-controlled liquid supply manifold 505 when the relative humidity around the head 100 increases.

As a result, the environment surrounding the head 100 is dehumidified and the condensation on the nozzle face 101*a* of the head 100 is inhibited.

The inhibition of condensation on the nozzle face 101*a* is described with reference to the saturated vapor diagram of FIG. 9. In the saturated vapor diagram of FIG. 9, the horizontal axis represents the ambient temperature, the vertical axis on the left represents the absolute humidity, and the vertical axis on the right represents the relative humidity (RH).

When continuous printing is performed in an ordinary temperature environment (25° C.), the temperature of the temperature-controlled liquid supply manifold 505 is 27° C., and the ambient temperature of the nozzle face 101*a* is 34° C.

When the temperature of the temperature-controlled liquid supply manifold 505 is 27° C. and the relative humidity (RH) is 100%, the ink evaporates from the sheet P, and the amount of vapor around the temperature-controlled liquid supply manifold 505 increases. Then, since the dew point in the environment of 27° C. is exceeded, condensation occurs on the surface of the temperature-controlled liquid supply manifold 505. On the other hand, when the temperature of the head 100 is 34° C., the relative humidity (RH) is about 70%. Thus, condensation does not occur on the nozzle face 101*a* of the head 100.

Therefore, keeping the temperature of the temperature-controlled liquid supply manifold 505 at 27° C. is advantageous. That is, even when the relative humidity of the surroundings rises, condensation occurs on the temperature-controlled liquid supply manifold 505 and the increase of the relative humidity is inhibited. Therefore, condensation on the nozzle face 101*a* can be prevented.

In this way, the temperature control of the head and the inhibition of condensation on the head can be performed by the same means.

Figure 10:
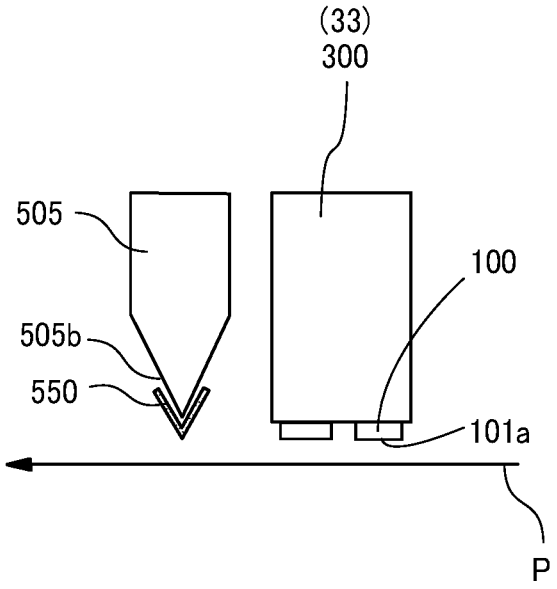
FIG. 10 is a diagram illustrating a configuration around a head according to a second embodiment of the present disclosure.

Next, a second embodiment of the present disclosure is described with reference to FIG. 10. FIG. 10 is a schematic view illustrating a configuration around the head according to the second embodiment.

In the present embodiment, a bottom 505*b* of the temperature-controlled liquid supply manifold 505 has a triangular shape. In other words, the bottom 505*b* is tapered downward. A water-absorbent polymer sheet 550 as a water absorber is attached to the bottom 505*b* of the temperature-controlled liquid supply manifold 505.

Since condensate water droplets adhere to the temperature-controlled liquid supply manifold 505, the water absorber can prevent the water droplets from dripping on the sheet P or the like.

The triangular bottom 505*b* of the temperature-controlled liquid supply manifold 505 can guide the water drops by condensation to the water-absorbent polymer sheet 550.

When the water-absorbent polymer sheet 550 is wet, the temperature-controlled liquid supply manifold 505 is heated between print jobs to evaporate the water from the water-absorbent polymer sheet 550. At this time, the temperature-controlled liquid temperature controller 801 applies a dummy signal to the head drive board 160 to heat the temperature-controlled liquid 510 to, for example, 35 to 40° C.

Accordingly, the water-absorbent polymer sheet 550 can maintain the water absorbency for a long period of time.

Figure 11:
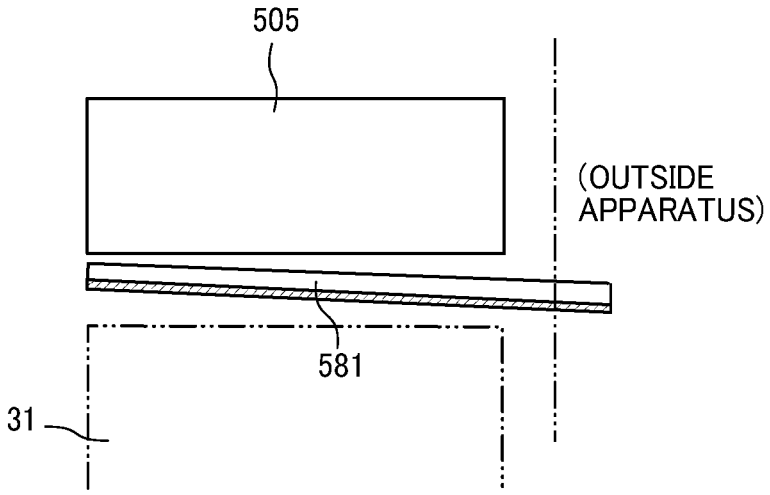
FIG. 11 is a side view of a liquid discharge apparatus according to a third embodiment of the present disclosure.

Next, a third embodiment of the present disclosure is described with reference to FIG. 11. FIG. 11 is a side view around the temperature-controlled liquid supply manifold 505 according to the third embodiment.

In the present embodiment, a guide 581 that discharges water droplets outside the apparatus is disposed below the temperature-controlled liquid supply manifold 505. The guide 581 extends in the width direction (the axial direction of the drum 31) and inclined down toward the outside of the printer 1. The guide 581 causes the received water droplets to flow down under the gravity, and the water droplets are collected outside the printer 1.

This structure can prevent the condensate water droplets on the temperature-controlled liquid supply manifold 505 from dropping on the sheet P or the like.

Figure 12:
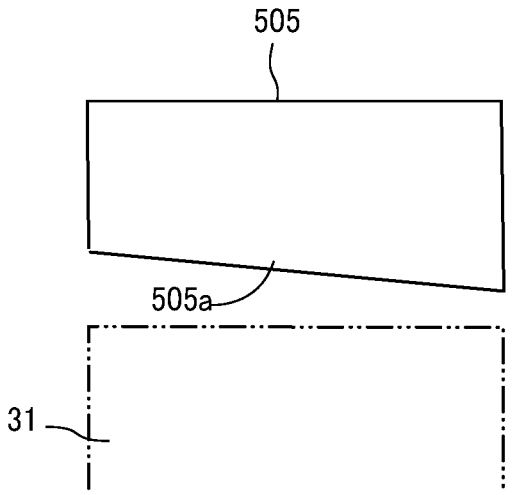
FIG. 12 is a side view of a liquid discharge apparatus according to a fourth embodiment of the present disclosure.

Next, a fourth embodiment of the present disclosure is described with reference to FIG. 12. FIG. 12 is a schematic side view of the temperature-controlled liquid supply manifold according to the fourth embodiment.

In the present embodiment, the bottom face 505*a* of the temperature-controlled liquid supply manifold 505 is inclined in the sheet width direction (axial direction of the drum 31) down to the outside, to guide the water droplets that have adhered thereon to the outside in the sheet width direction along the inclination of the bottom face 505*a*. Then, the water droplets are collected.

This structure can prevent the condensate water droplets on the temperature-controlled liquid supply manifold 505 from dropping on the sheet P or the like.

Figure 13:
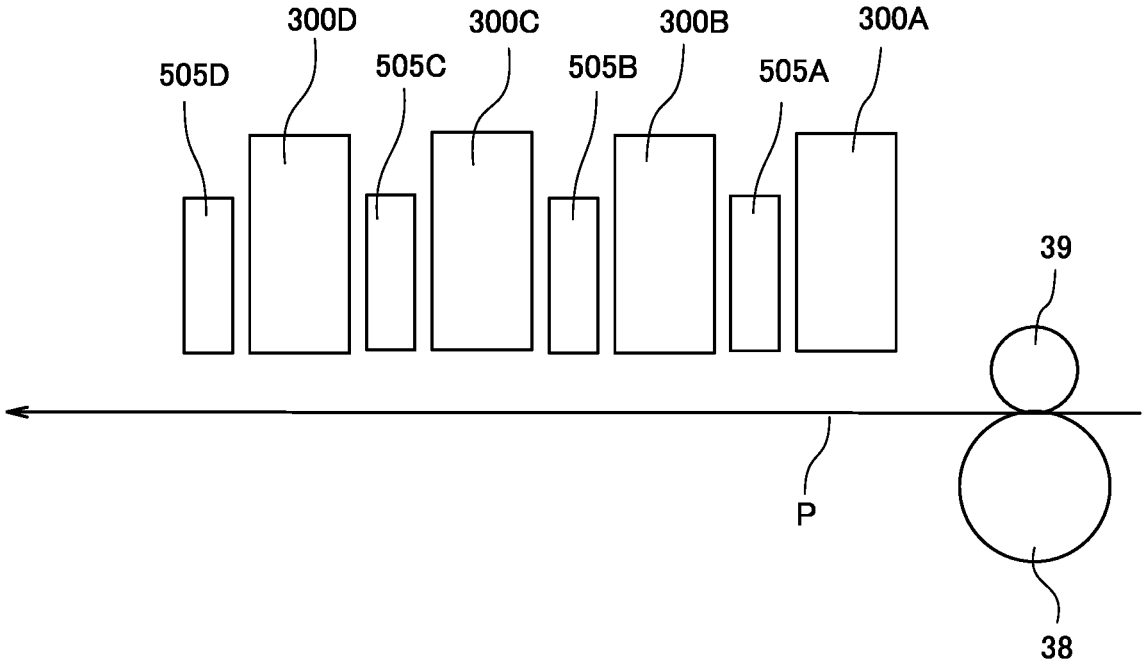
FIG. 13 is a front view illustrating an arrangement of a head unit and a temperature-controlled liquid supply manifold according to a fifth embodiment of the present disclosure.

Next, a fifth embodiment of the present disclosure is described with reference to FIG. 13. FIG. 13 is a front view illustrating an arrangement of the head unit and the temperature-controlled liquid supply manifold according to the fifth embodiment of the present disclosure.

In the present embodiment, the sheet P is sandwiched between a conveyance roller 38 and a pressure roller 39, and is linearly conveyed so as to face the head units 300A to 300D. Similar to the first embodiment, the temperature-controlled liquid supply manifolds 505A to 505D are disposed downstream from the head units 300A to 300D, respectively, in the sheet conveyance direction.

Also with such a configuration, effects similar to those of the first embodiment can be obtained.

Figure 14:
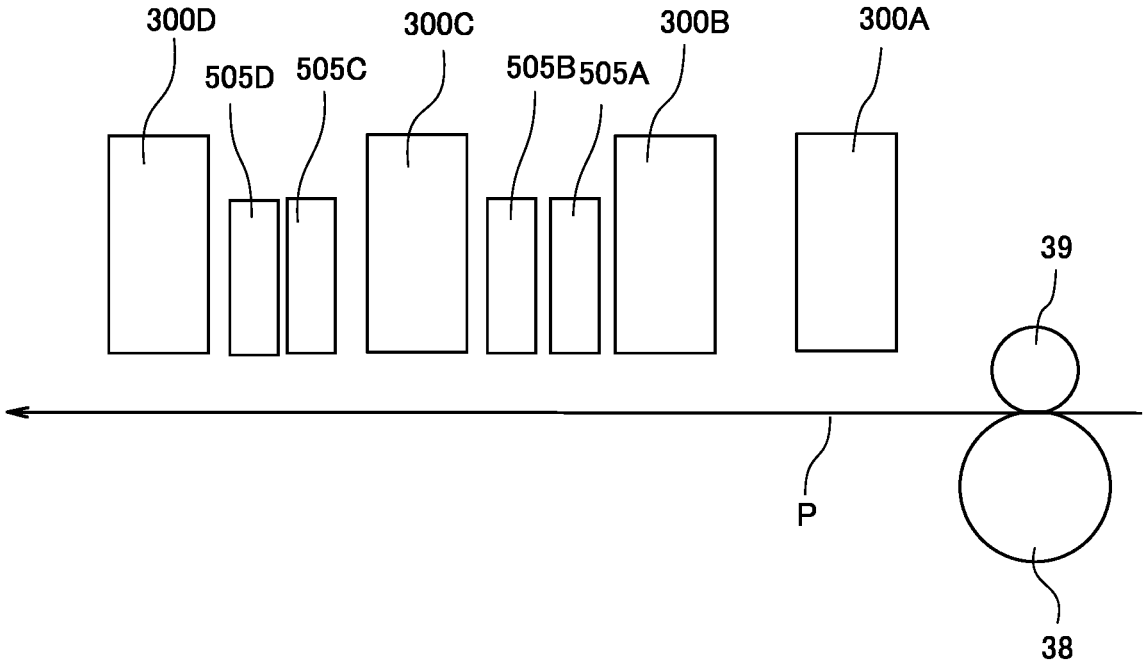
FIG. 14 is a front view illustrating an arrangement of a head unit and a temperature-controlled liquid supply manifold according to a sixth embodiment of the present disclosure.

Next, a sixth embodiment of the present disclosure is described with reference to FIG. 14. FIG. 14 is a front view illustrating an arrangement of the head unit and the temperature-controlled liquid supply manifold according to the sixth embodiment of the present disclosure.

In this embodiment, the two temperature-controlled liquid supply manifolds 505A and 505B are disposed between the head units 300B and 300C. Further, two temperature-controlled liquid supply manifolds 505C and 505D are disposed between the head units 300C and 300D.

Even such an arrangement of the temperature-controlled liquid supply manifolds 505, the temperature control of the head 100 and inhibition of the condensation on the nozzle face 101*a* of the head 100 can be performed by the same means. Since the sheet P is warmed more and the amount of evaporation of moisture increases on the downstream side in the conveyance passage, condensation is more likely to occur on the head 100 on the downstream side in the conveyance passage. Therefore, localizing the temperature-controlled liquid supply manifolds 505 on the downstream side in the conveyance passage is advantageous in more effectively inhibiting the condensation.

Figure 15:
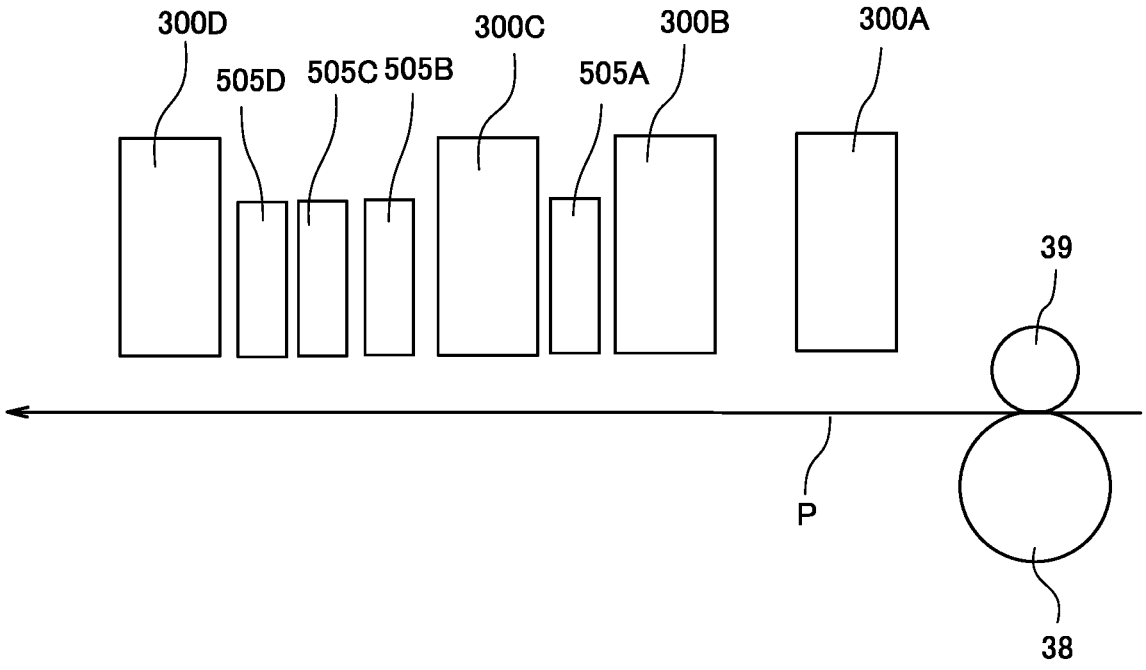
FIG. 15 is a front view illustrating an arrangement of a head unit and a temperature-controlled liquid supply manifold according to a seventh embodiment of the present disclosure.

Next, a seventh embodiment of the present disclosure is described with reference to FIG. 15. FIG. 15 is a front view illustrating an arrangement of the head unit and the temperature-controlled liquid supply manifold according to the seventh embodiment.

In this embodiment, one temperature-controlled liquid supply manifold 505A is disposed between the head units 300B and 300C. Further, three temperature-controlled liquid supply manifolds 505B, 505C, and 505D are disposed between the head units 300C and 300D.

Accordingly, the condensation on the head on the downstream side in the conveyance passage can be suppressed more effectively.

The localized arrangement of the temperature-controlled liquid supply manifolds 505 is not limited to those of the fifth and sixth embodiments.

Figure 16:
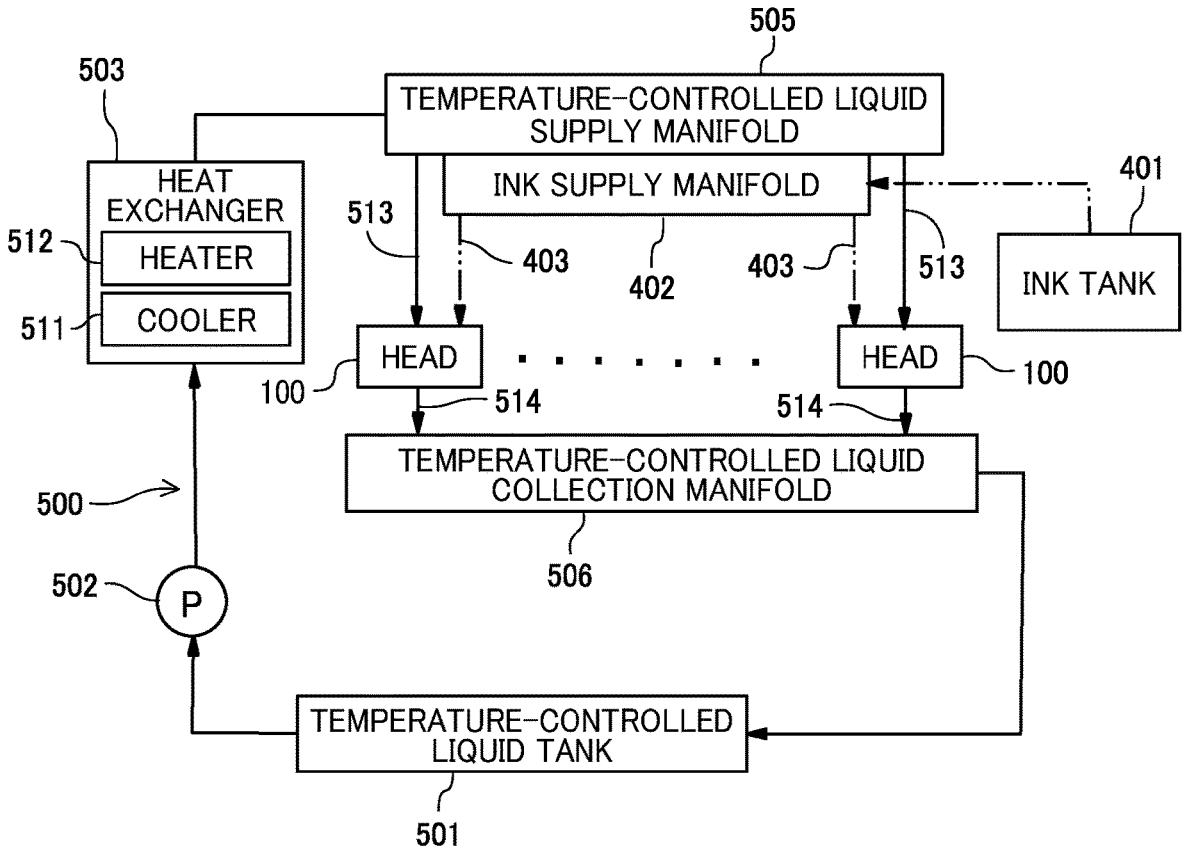
FIG. 16 is a block diagram illustrating a liquid (ink) supply system and a temperature-controlled liquid circulation system according to an eighth embodiment of the present disclosure.

Next, an eighth embodiment of the present disclosure is described with reference to FIG. 16. FIG. 16 is a block diagram illustrating a liquid (ink) supply system and a temperature-controlled liquid circulation system according to the eighth embodiment.

The temperature-controlled liquid circulation system of the present embodiment includes a heat exchanger 503 that exchanges heat with the temperature-controlled liquid 510. The heat exchanger 503 includes the radiator 511 that cools the temperature-controlled liquid 510 and a heater 512 that heats the temperature-controlled liquid 510. The heat exchanger 503 is a temperature adjuster that heats or cools the temperature-adjustment liquid to adjust the temperature thereof, under control of the temperature-controlled liquid temperature controller 801. In the temperature-controlled liquid circulation system of the present embodiment, the ink supply manifold 402 and the temperature-controlled liquid supply manifold 505 are thermally coupled.

As a result, the temperature of the ink can be adjusted to the required temperature before the ink is supplied to each head 100, and ink discharge can be stable.

The rotation of the fan 511*a* (illustrated in FIG. 5) of the radiator 511 can be controlled in the same manner as in the first embodiment.

Figure 17:
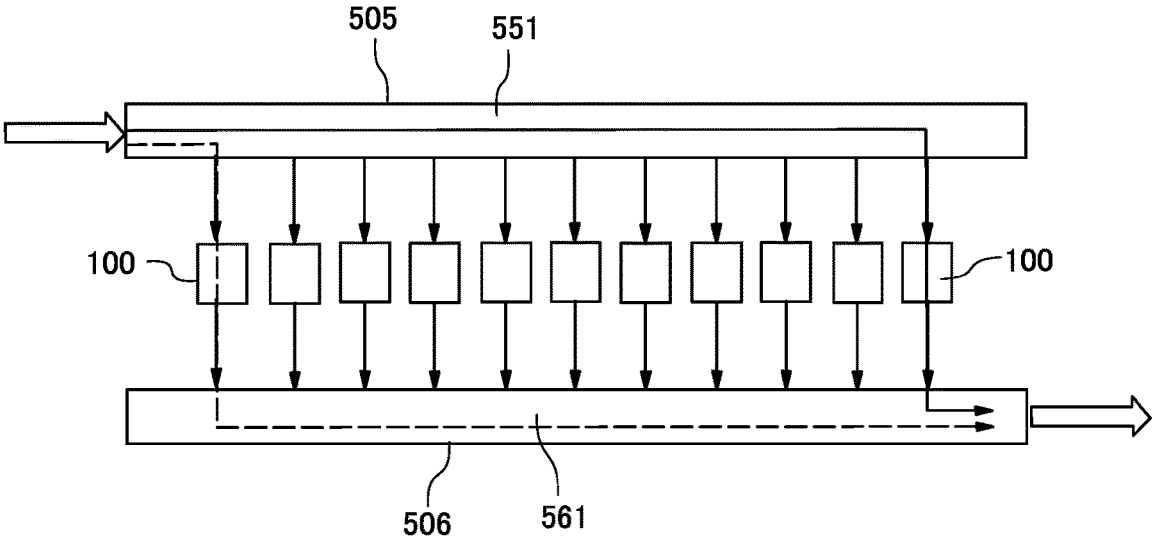
FIG. 17 is a view illustrating a temperature-controlled liquid supply manifold and a connection between the temperature-controlled liquid collection manifold with heads, according to the eighth embodiment.

Next, a description is given of the connections of the temperature-controlled liquid supply manifold and the temperature-controlled liquid collection manifold with the heads, with reference to FIG. 17. FIG. 17 is a schematic cross-sectional side view thereof.

An extreme upstream outlet port of a temperature-controlled liquid channel 551 of the temperature-controlled liquid supply manifold 505 is coupled, via the head 100, to an extreme upstream inlet of a liquid channel 561 of the temperature-controlled liquid collection manifold 506. Similarly, a second outlet port from the upstream side of the temperature-controlled liquid channel 551 is coupled, via the head 100, to a second inlet port, from the upstream side of the liquid channel 561, of the temperature-controlled liquid collection manifold 506. The subsequent connections are similar thereto. An extreme downstream outlet port of the temperature-controlled liquid channel 551 is coupled, via the head 100, to an extreme downstream inlet port of the liquid channel 561 of the temperature-controlled liquid collection manifold 506.

Such connection relationships can equalize the configurations of the liquid channels of the temperature-controlled liquid that pass through all the heads 100, thereby equalizing the pressure loss in the liquid channels of the temperature-controlled liquid passing through the heads 100. Accordingly, the flow rates and flow speeds are equalized, and the temperature can be equally adjusted in all the heads 100.

In this case, the temperature-controlled liquid collection manifold 506 is preferably made of the same material and has the same length as the temperature-controlled liquid supply manifold 505. For example, an extruded aluminum alloy such as A6063 can be used to produce the temperature-controlled liquid supply manifold 505 and the temperature-controlled liquid collection manifold 506 by extrusion molding. Then, the manufacturing cost can be low.

Figure 18:
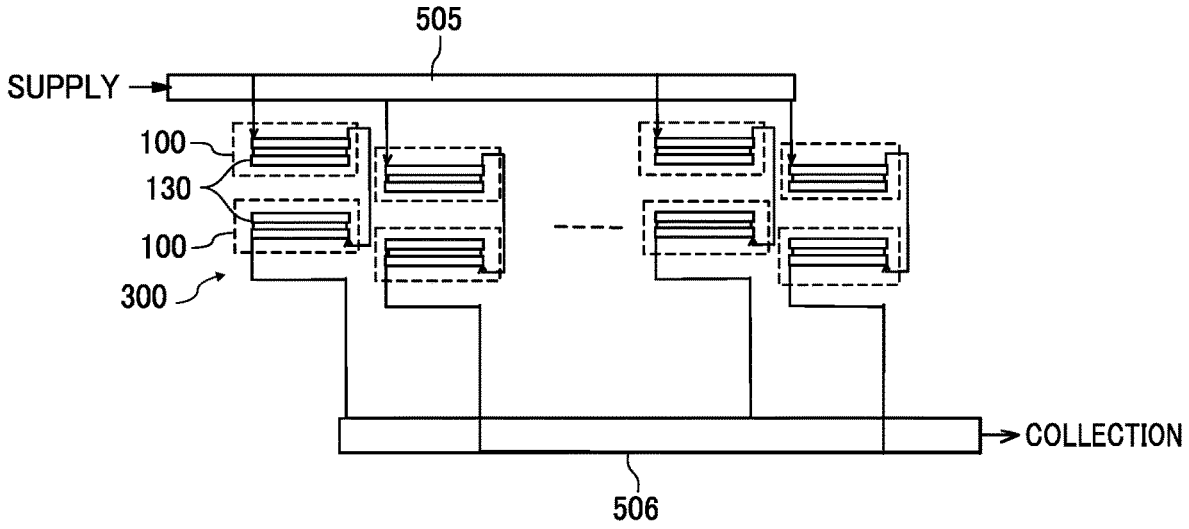
FIG. 18 is a diagram illustrating a configuration of a head unit and a temperature-controlled liquid circulation passage according to a ninth embodiment of the present disclosure.
Figure 19:
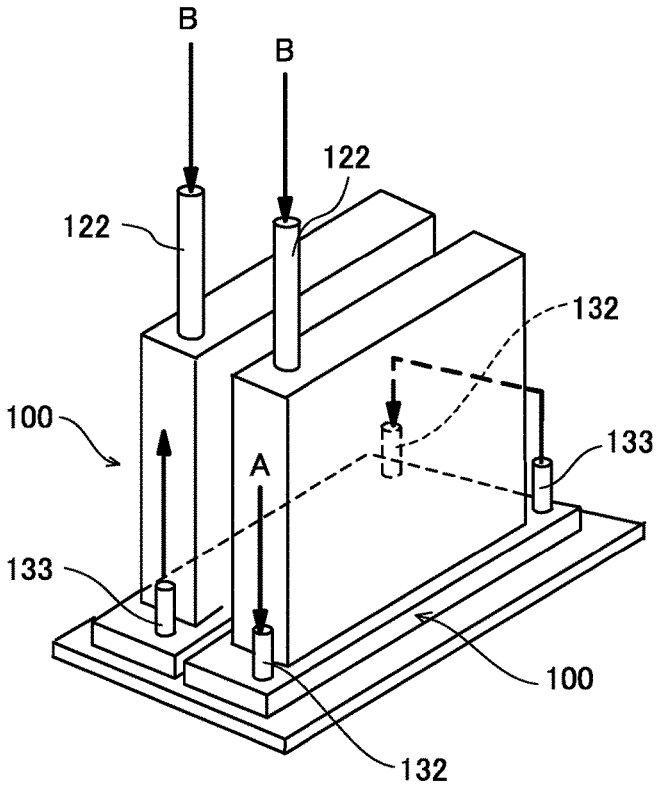
FIG. 19 is a perspective view of the head unit according to the ninth embodiment.

Next, a description is given of a ninth embodiment of the present disclosure, with reference to FIGS. 18 and 19. FIG. 18 is a schematic diagram illustrating a configuration of the head unit and the circulation passage of the temperature-controlled liquid according to the ninth embodiment. FIG. 19 is a perspective view thereof.

The head unit 300 includes pairs of heads 100 (dual heads) to discharge liquid, arranged in a staggered arrangement.

The temperature-controlled liquid 510 is supplied from the temperature-controlled liquid supply manifold 505 to the temperature-controlled liquid supply port 132 of the first one of the pair of heads 100 (indicated by arrow A in FIG. 19). Then, the temperature-controlled liquid 510 passes through the frame 120 of the first head 100 and is collected from the temperature-controlled liquid collection port 133.

The temperature-controlled liquid 510 collected from the first head 100 is supplied to the temperature-controlled liquid supply port 132 of the second head 100. Then, the temperature-controlled liquid 510 passes through the frame 120 of the second head 100 and is collected from the temperature-controlled liquid collection port 133.

The temperature-controlled liquid 510 collected from the temperature-controlled liquid collection port 133 of the second head 100 is collected in the temperature-controlled liquid collection manifold 506.

Note that ink is supplied to each head 100 through the ink supply port 122, as indicated by broken arrow B in FIG. 19.

Figure 20:
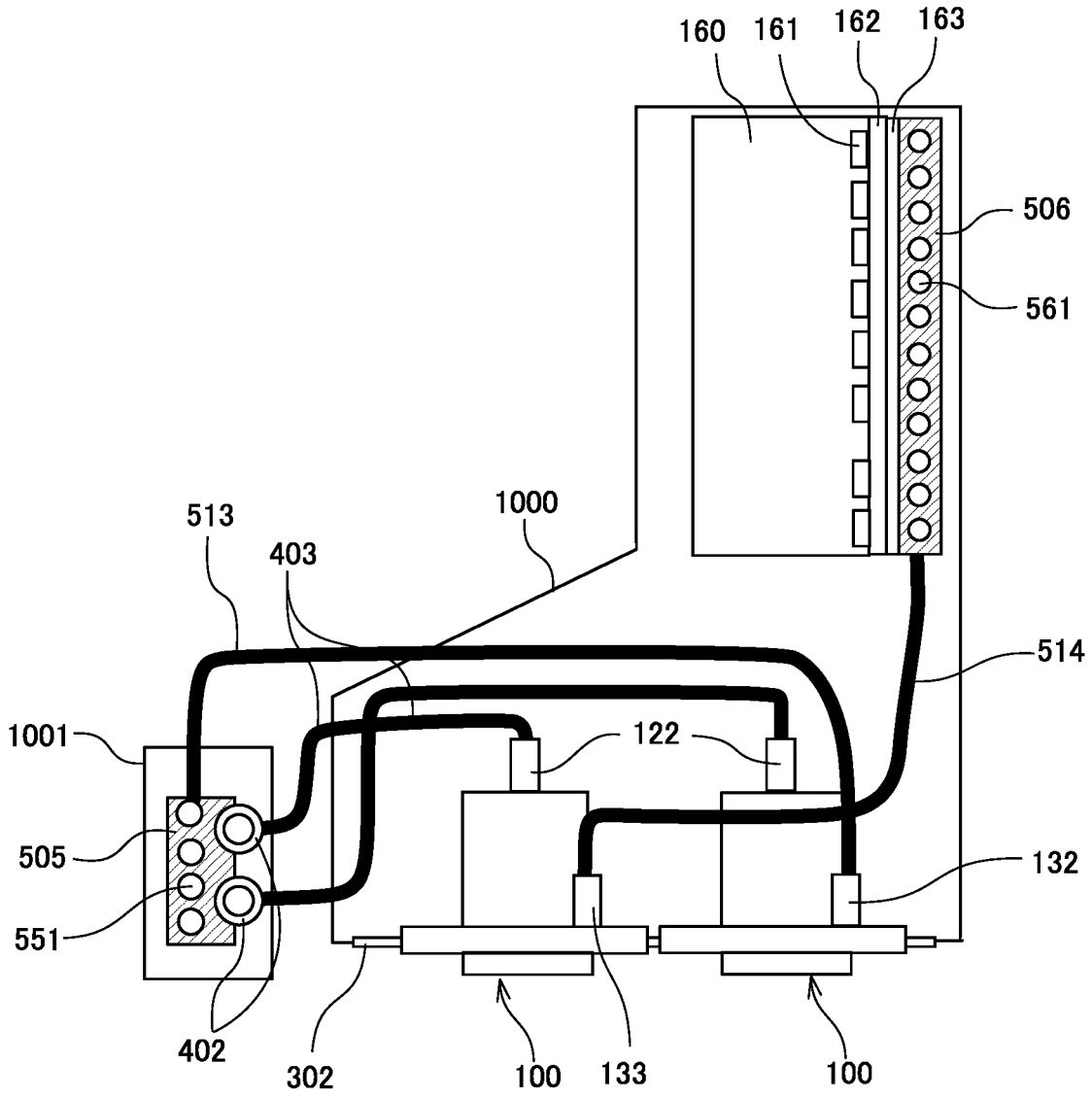
FIG. 20 is a view illustrating a configuration around heads, a temperature-controlled liquid supply manifold, and a temperature-controlled liquid collection manifold according to a tenth embodiment.

Next, a tenth embodiment of the present disclosure is described with reference to FIG. 20. FIG. 20 is a view illustrating a configuration around the heads 100, the temperature-controlled liquid supply manifold 505, and the temperature-controlled liquid collection manifold 506 in the tenth embodiment.

The temperature-controlled liquid collection manifold 506 has therein the liquid channel 561 through which the temperature-controlled liquid 510 supplied via the collection passage 514 from each head 100 flows. The liquid channel 561 is constructed of a plurality of channels and includes turnups at both ends of those channels, so that the plurality of channels are connected.

On the head drive board 160 mounted with the drive circuit for the head 100, a power amplification unit 161 that amplifies a drive waveform is mounted, and a heatsink 162 is disposed in contact with the power amplification unit 161. The power amplification unit 161 is constructed of, for example, a metal-oxide semiconductor field-effect transistor (MOSFET).

In this structure, the heatsink 162 of the head drive board 160 is secured to the temperature-controlled liquid collection manifold 506 via a thermal conduction sheet 163, thereby thermally coupling the temperature-controlled liquid collection manifold 506 and the power amplification unit 161 of the head drive board 160.

The head drive board 160 thermally coupled to the temperature-controlled liquid collection manifold 506 is disposed higher than the heads 100. Therefore, the temperature rise of the head 100 can be inhibited.

The head drive board 160, the temperature-controlled liquid collection manifold 506, and the heads 100 are combined by a cover 1000, and the temperature-controlled liquid supply manifold 505 is separate therefrom.

The temperature-controlled liquid supply manifold 505 is at a distance from the temperature-controlled liquid collection manifold 506.

As a result, the environment surrounding the head 100 is dehumidified and the condensation on the nozzle face 101*a* of the head 100 is inhibited.

The temperature-controlled liquid supply manifold 505 can be housed in a cover 1001, or, alternatively, the temperature-controlled liquid supply manifold 505 can be exposed without the cover 1001.

In the present disclosure, the liquid to be discharged is not limited to a particular liquid as long as the liquid has a viscosity or surface tension to be discharged from a head (a liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink; surface treatment liquid; a liquid for forming an electronic element component, a light-emitting element component, or an electronic circuit resist pattern; or a material solution for three-dimensional fabrication.

The term "head" signifies liquid discharge heads employing, as an energy source to generate energy to discharge liquid, a piezoelectric actuator (a laminated piezoelectric element or a thin-film piezoelectric element), a thermal actuator that employs an electrothermal transducer element, such as a heat element, or an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The "liquid discharge apparatus" can be, for example, an image forming apparatus to form an image on a sheet by discharging ink, or a three-dimensional fabricating apparatus to discharge a fabrication liquid to powder layers in which a powder material is piled in layers, to form a three-dimensional fabricated object.

The "liquid discharge apparatus" is not limited to an apparatus to discharge liquid to visualize meaningful images, such as letters or figures. For example, the liquid discharge apparatus can be an apparatus to form meaningless patterns, or an apparatus to fabricate three-dimensional images.

The above-mentioned term "material to which liquid can adhere" represents a material which allow liquid can, at least temporarily, adhere thereto and solidify thereon, or a material into which liquid permeates. Examples of the "material to which liquid can adhere" include recording media, such as paper, recording paper, recording sheets, film, and cloth; electronic components, such as electronic substrate and a piezoelectric element; and media, such as a powder layer, an organ model, and a testing cell. The "material to which liquid can adhere" includes any material to which liquid adheres, unless otherwise specified.

The above-mentioned "material to which liquid adheres" can be any material, such as paper, thread, fiber, cloth, leather, metal, plastic, glass, wood, ceramics, or the like, as long as liquid can temporarily adhere.

The "liquid discharge apparatus" can be an apparatus to relatively move the liquid discharge head and a material onto which liquid can adhere. However, the liquid discharge apparatus is not limited to such an apparatus. For example, the liquid discharge apparatus can be a serial head apparatus that moves the liquid discharge head or a line head apparatus that does not move the head.

Examples of the "liquid discharge apparatus" further include a treatment liquid coating apparatus to discharge a treatment liquid to a sheet to coat the sheet surface with the treatment liquid, thereby reforming the sheet surface. Another example is an injection granulation apparatus to discharge, through nozzles, a composition liquid including raw materials dispersed in a solution, thereby granulating fine particles of the raw materials.

The terms "image formation," "recording," "printing," "image printing," and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a plurality of head units each of which includes a plurality of heads configured to discharge a liquid;

a plurality of temperature-controlled liquid supply manifolds each of which is configured to distribute a temperature-controlled liquid to the plurality of heads of one of the plurality of head units; and a conveyor configured to convey a sheet onto which the liquid is applied by the plurality of head units, the conveyor defining a sheet conveyance passage opposite the plurality of head units, at least one of the plurality of temperature-controlled liquid supply manifolds is disposed between two of the plurality of head units and in a vicinity of the sheet conveyance passage.

2. The liquid discharge apparatus according to claim 1, wherein each of the plurality of temperature-controlled liquid supply manifolds is downstream from corresponding one of the plurality of head units in a direction of conveyance of the sheet in the sheet conveyance passage.

3. The liquid discharge apparatus according to claim 1, further comprising:

an ambient temperature sensor configured to detect an ambient temperature of the plurality of head units;

a liquid temperature sensor configured to detect a temperature of the temperature-controlled liquid;

a temperature adjuster configured to perform at least one of heating and cooling of the temperature-controlled liquid; and control circuitry configured to:

in response to a detection that the ambient temperature is lower than a threshold temperature, cause the temperature adjuster to adjust the temperature of the temperature-controlled liquid to the threshold temperature; and in response to a detection that the ambient temperature is higher than the threshold temperature, cause the temperature adjuster to adjust the temperature of the temperature-controlled liquid to the ambient temperature.

4. The liquid discharge apparatus according to claim 1, further comprising:

a circulation passage through which the temperature-controlled liquid circulates via the plurality of heads, the circulation passage including:

a liquid feeder configured to feed the temperature-controlled liquid; and a cooler configured to cool the temperature-controlled liquid, wherein a flow rate of the temperature-controlled liquid is five times or greater of a maximum supply amount of the liquid supplied to the plurality of head units.

5. The liquid discharge apparatus according to claim 1, further comprising a plurality of liquid supply manifolds configured to distribute the liquid to the plurality of heads of the plurality of head units, respectively, each of the plurality of liquid supply manifolds thermally coupled with corresponding one of the plurality of temperature-controlled liquid supply manifolds.

6. The liquid discharge apparatus according to claim 1, further comprising a plurality of water absorbers configured to absorb moisture and disposed on a portion of each of the plurality of temperature-controlled liquid supply manifolds, the portion being in a vicinity of the sheet conveyance passage.

7. The liquid discharge apparatus according to claim 6, further comprising:

a circulation passage through which the temperature-controlled liquid flows;

a heat generator configured to generate heat and coupled with the plurality of temperature-controlled liquid supply manifolds; and control circuitry configured heat, with the heat generator, the plurality of temperature-controlled liquid supply manifolds to dry the plurality of water absorbers.

8. The liquid discharge apparatus according to claim 1, further comprising:

a plurality of drive circuits configured to drive the plurality of head units, respectively; and a plurality of temperature-controlled liquid collection manifolds configured to collect the temperature-controlled liquid from the plurality of head units, respectively, wherein each of the plurality of drive circuits and each of the plurality of temperature-controlled liquid collection manifolds are disposed higher than corresponding one of the plurality of head units, and wherein each of the plurality of drive circuits is thermally coupled with corresponding one of the plurality of temperature-controlled liquid collection manifolds.

* * * * *